US010501919B2

(12) United States Patent
Chong et al.

(10) Patent No.: US 10,501,919 B2
(45) Date of Patent: Dec. 10, 2019

(54) APRON-FRONT SINK

(71) Applicant: Elkay Manufacturing Company, Oak Brook, IL (US)

(72) Inventors: Jonathan Chee Yeen Chong, Chicago, IL (US); Sharon Dupuy, Chicago, IL (US); John Conway, Oak Brook, IL (US); Myrna Morales, Oak Brook, IL (US); Christopher Waas, North Riverside, IL (US); Erik Lynch, Downers Grove, IL (US); Brian Chung, Oak Brook, IL (US); Norris Swilley, Oak Brook, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 0 days.

(21) Appl. No.: 15/864,717

(22) Filed: Jan. 8, 2018

(65) Prior Publication Data

US 2018/0187403 A1 Jul. 5, 2018

Related U.S. Application Data

(63) Continuation-in-part of application No. 15/398,578, filed on Jan. 4, 2017, now abandoned.

(51) Int. Cl.

| | |
|---|---|
| ***E03C 1/33*** | (2006.01) |
| ***E03C 1/182*** | (2006.01) |
| ***A47B 77/06*** | (2006.01) |
| ***E03C 1/18*** | (2006.01) |

(52) U.S. Cl.

CPC ..... *E03C 1/335* (2013.01); *A47B 77/06* (2013.01); *E03C 1/18* (2013.01); *E03C 1/182* (2013.01)

(58) Field of Classification Search

CPC ..... E03C 1/335
USPC ..... 4/619
See application file for complete search history.

(56) References Cited

U.S. PATENT DOCUMENTS

| | | | | |
|---|---|---|---|---|
| 1,453,945 | A | 5/1923 | Peterson | |
| D313,068 | S | 12/1990 | Kohler, Jr. et al. | |
| D353,652 | S | 12/1994 | Dannenberg | |
| 5,864,898 | A * | 2/1999 | Knapp | A47K 3/161 4/584 |
| 5,940,906 | A | 8/1999 | Halloran | |
| 6,154,895 | A | 12/2000 | Pisklak | |
| D560,773 | S | 1/2008 | Kitzmiller | |
| 7,377,661 | B2 | 5/2008 | Douglass | |
| D603,946 | S | 11/2009 | Eckhaus | |
| D620,091 | S | 7/2010 | Eckhaus | |
| D620,092 | S | 7/2010 | Eckhaus | |
| D620,093 | S | 7/2010 | Eckhaus | |
| D624,635 | S | 9/2010 | Eckhaus | |
| D624,636 | S | 9/2010 | Eckhaus | |
| D627,449 | S | 11/2010 | Eckhaus | |

(Continued)

*Primary Examiner* — Lori L Baker
(74) *Attorney, Agent, or Firm* — Leydig, Voit & Mayer, Ltd.

(57) ABSTRACT

A sink includes a basin body having a generally concave shape that forms at least one sink basin, a top flange integrally formed with the basin body, the top flange extending around the at least one sink basin, an apron connected to a front edge of the top flange, a replaceable panel removably connected to the apron, and a fastening system disposed between the apron and the replaceable panel, the fastening system releasably connecting the replaceable panel to the apron.

28 Claims, 20 Drawing Sheets

(56) References Cited

U.S. PATENT DOCUMENTS

| | | | | |
|---|---|---|---|---|
| D651,699 | S | 1/2012 | Booth et al. | |
| D655,798 | S | 3/2012 | Miller et al. | |
| D662,574 | S | 6/2012 | Booth et al. | |
| D663,389 | S | 7/2012 | Miller et al. | |
| D663,395 | S | 7/2012 | Miller et al. | |
| D670,364 | S | 11/2012 | Miller et al. | |
| D670,366 | S | 11/2012 | Booth et al. | |
| D670,367 | S | 11/2012 | Miller et al. | |
| D671,197 | S | 11/2012 | Miller et al. | |
| D675,300 | S | 1/2013 | Miller et al. | |
| D685,456 | S | 7/2013 | Eckhaus | |
| D685,457 | S | 7/2013 | Eckhaus | |
| D702,333 | S | 4/2014 | Eckhaus | |
| 8,844,070 | B2 * | 9/2014 | Booth | A47B 77/06 4/631 |
| 9,173,487 | B2 | 11/2015 | Booth et al. | |
| 9,486,113 | B2 | 11/2016 | Zimbric | |
| 9,492,010 | B2 * | 11/2016 | Booth | A47B 77/06 |
| 9,492,011 | B2 | 11/2016 | Booth et al. | |

* cited by examiner

APRON-FRONT SINK

CROSS-REFERENCE TO RELATED APPLICATIONS

This patent application is a continuation-in-part application of co-pending U.S. patent application Ser. No. 15/398,578, filed Jan. 4, 2017, which is incorporated by reference in its entirety.

FIELD OF THE DISCLOSURE

The present disclosure relates to sinks and, more particularly, apron-front sinks.

BACKGROUND OF THE INVENTION

Sinks with aprons, which are also sometimes referred to as farmhouse sinks, are a popular type of sink used in residential and commercial applications. Such sinks can be constructed from various materials including fireclay, copper, steel, and the like, and also from composite materials such as engineered stone, which is a composite material made from crushed stone that is bound together by an adhesive such as a polymer resin.

Sinks of this style are typically formed or fabricated to a desired shape in which a sink basin includes an apron, which is visible from the front of the cabinet or stand into which the sink is installed. While various materials can be used to provide a desired aesthetic effect, when the surrounding cabinets or décor is updated, the sink and other fixtures often require replacement. Sinks in general, and especially apron sinks, are heavy and typically require modification of the base cabinet when a different sink is installed because of the modifications that are required to install the original sink and remove a front portion of the cabinet to accommodate the apron. Replacement of a base cabinet along with the sink will typically increase the cost and complexity of a remodeling project.

SUMMARY OF THE DISCLOSURE

In one aspect, the disclosure describes a sink. The sink includes a basin body having a generally concave shape that forms at least one sink basin, a top flange integrally formed with the basin body, the top flange extending around the at least one sink basin, an apron connected to a front edge of the top flange, a replaceable panel removably connected onto the apron, and a fastening system disposed between the replaceable panel and the apron, the fastening system releasably connecting the replaceable panel to the apron.

In another aspect, the disclosure describes a method of using a sink having a replaceable panel connected to an apron. The method includes providing a basin body having a top flange integrally formed with the basin body, the top flange extending around the at least one sink basin. The method further includes providing an apron extending from a front edge of the top flange, and removably connecting a replaceable panel to the apron using a fastening system disposed between the replaceable panel and the apron.

In yet another aspect, the disclosure describes a method of assembling a sink having a replaceable panel connected to an apron. The method includes providing a sink having an apron, installing the sink into a cabinet section, and releasably securing a replaceable panel to the apron of the sink. In one embodiment, the method further includes removing the replaceable panel from the apron while the sink is installed into the cabinet section, and releasably securing a second replaceable panel to the apron of the sink while the sink is installed into the cabinet section.

DETAILED DESCRIPTION

Figure 1:
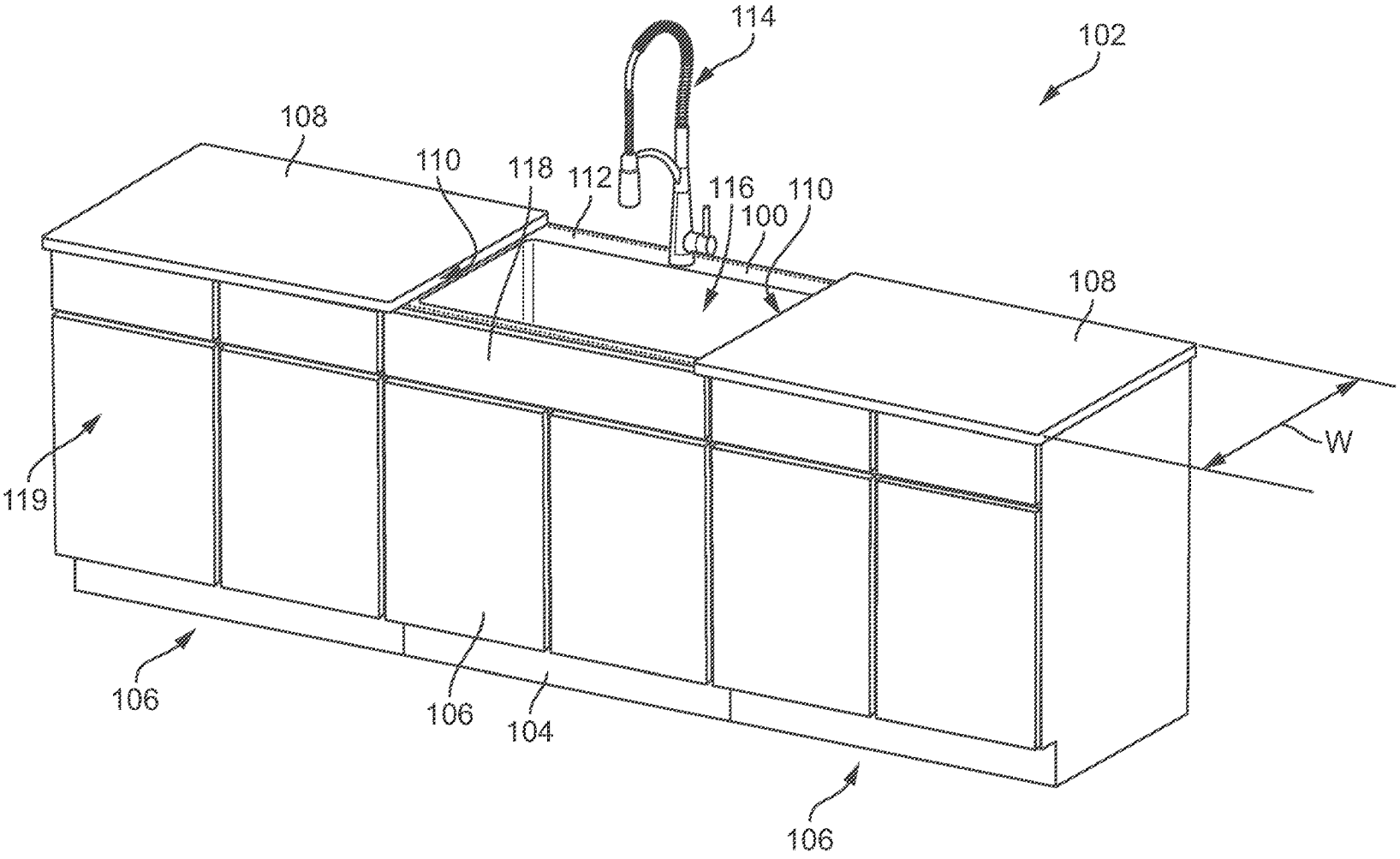
FIG. 1 is an outline view of an apron sink installed in a cabinet section in accordance with the disclosure.

The present disclosure is applicable for fixtures such as sinks that have aprons and, more particularly, to an apron sink having a removable or replaceable panel that is releasably connected to a front of the apron. A sink 100 installed in a cabinet section 102 is shown in FIG. 1. The installation of the sink 100 in the cabinet section 102 is shown as an exemplary installation for the sink 100, but other installation methods or types can also be used. In the embodiment shown, the sink 100 is installed on a base cabinet 104 and is surrounded by two side cabinets 106. Each of the two side cabinets 106 includes a countertop section 108 having an end 110 that faces the sink 100 and overlaps a top flange 112 of the sink 100. The top flange 112 of the sink 100 extends across an entire width, W (FIG. 1), and can include an opening to support a faucet 114 along a portion of the top flange 112 that defines a faucet deck as shown. The sink 100 further includes a basin 116 and a replaceable panel 118 that is exposed on the front side of the cabinet section 102 and forms a portion of a cabinet face 119.

Figure 2:
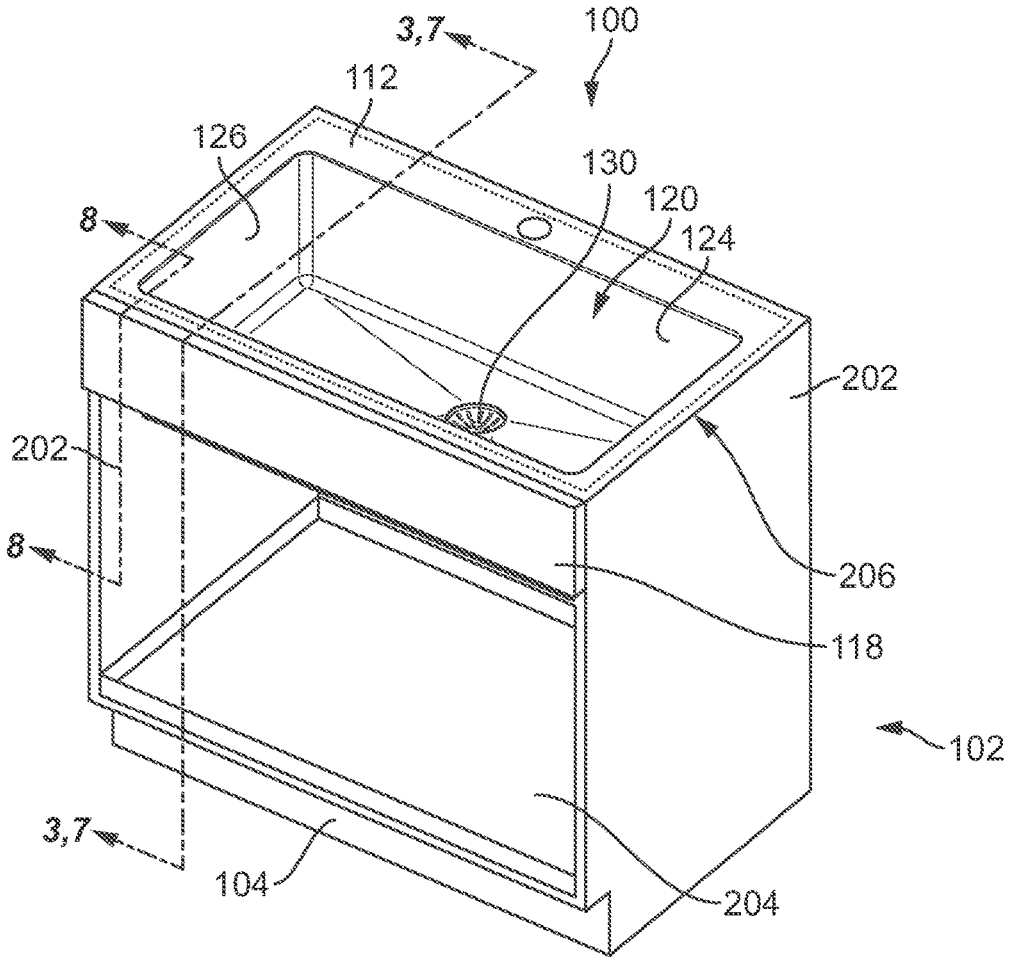
FIG. 2 is an outline view of an apron sink installed on a based cabinet in accordance with the disclosure.
Figure 3:
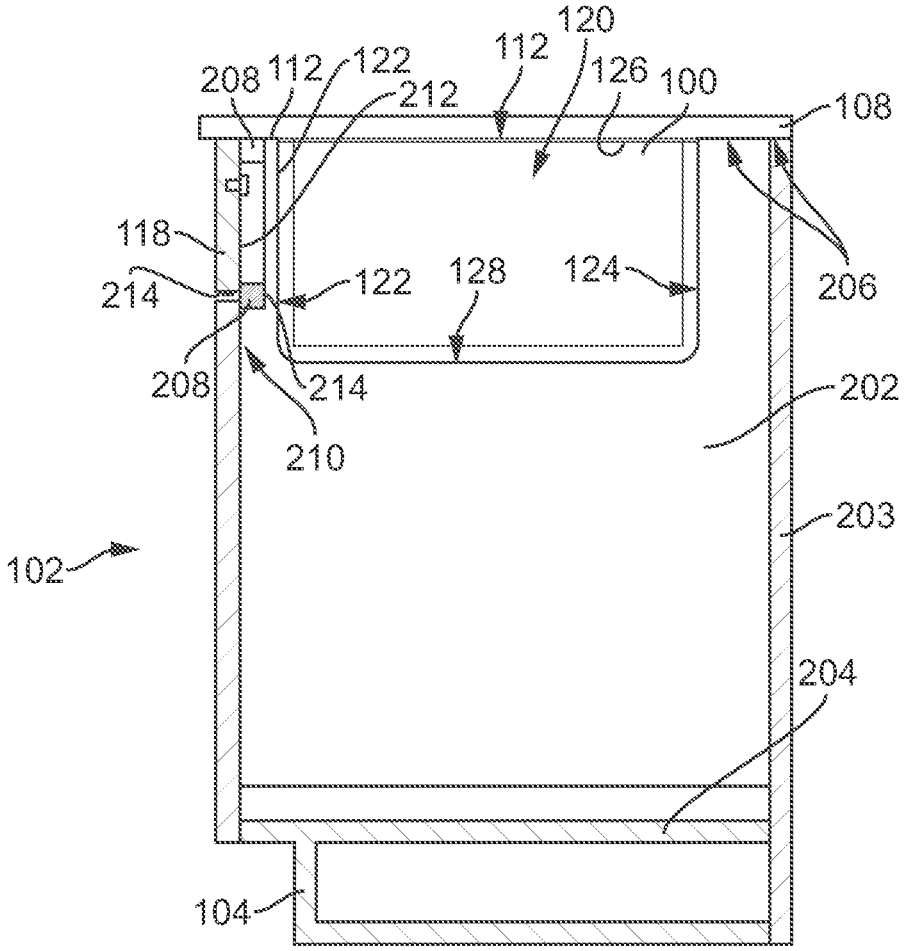
FIG. 3 is a cross sectional view of the sink of FIG. 1 as installed on a base cabinet.

An outline view of the sink 100 installed into the base cabinet 104 with the surrounding structures removed for illustration is shown in FIG. 2. A cross section view of the sink 100 installed in the base cabinet 104 is shown in FIG. 3. As can be seen from these illustrations, the base cabinet 104 includes two sidewalls 202, a back wall 203, and a floor 204 to form a generally rectangular box structure that is open at the top and front. The top flange 112 of the sink 100 rests along a top edge 206 of the side and back walls 202 and 203 to support the weight of the sink 100. Beams 208 connect the two sidewalls 202 along the top, front of the base cabinet 104 and, optionally, along the top of a cabinet door opening 210. As shown in FIG. 3, the top flange 112 includes an apron 212 that extends perpendicularly relative to the top flange 112 in a downward direction around the topmost beam 208. The apron 212 has a generally rectangular shape as is connected along its top edge to a front edge of the top flange 112. Along a bottom edge, the apron 212 includes a shelf 214 that extends perpendicularly relative to the apron 212 along a plane that is parallel to a plane defined by the top flange 112 in an outward direction. In the illustrated embodiment, the replaceable panel 118 is disposed in contact with and connected to the apron 212 and the shelf 214.

Figure 4:
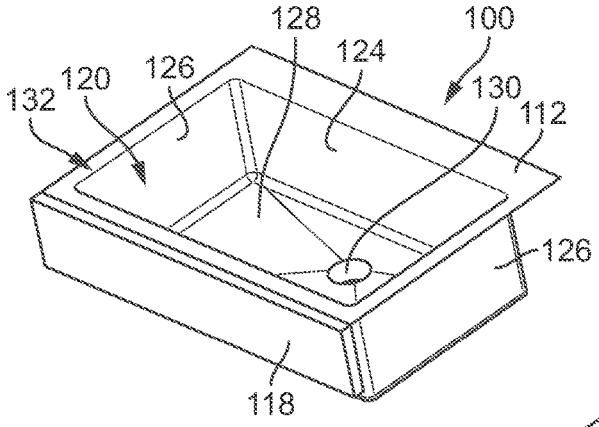
FIG. 4 is an outline view of a mixed material apron sink in accordance with the disclosure.
Figure 5:
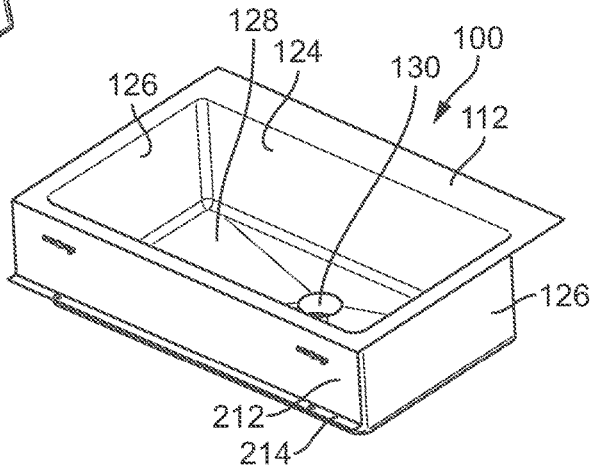
FIGS. 5 and 6 are disassembled views from different perspectives of a sink in accordance with the disclosure.
Figure 6:
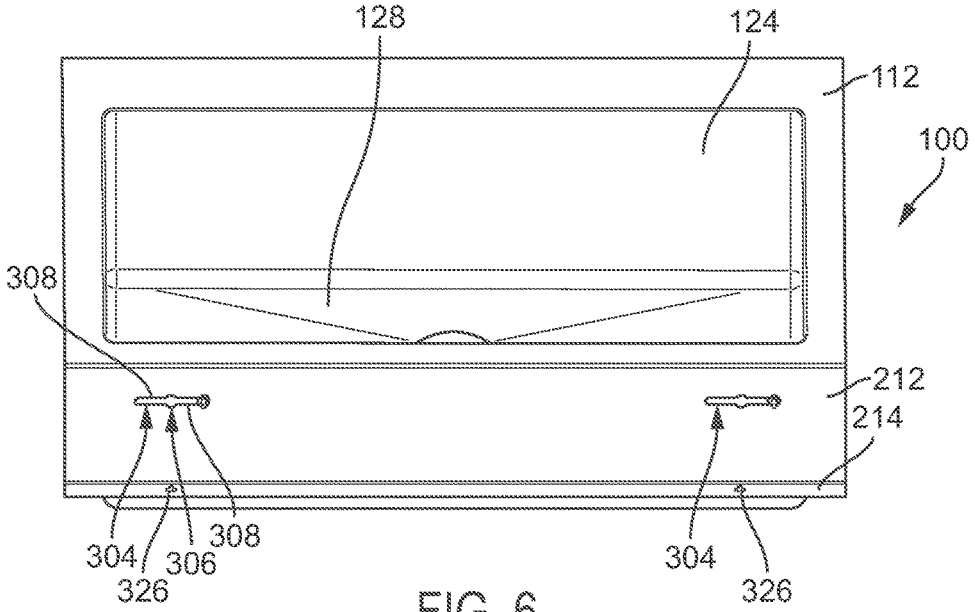

An outline view of the sink 100 is shown in FIG. 4, and partially disassembled views of the sink 100 are shown in FIGS. 5 and 6 from different perspectives. In the description that follows, structures and features of the sink 100 and/or the cabinet section 102 are denoted with the same reference numerals as previously used for simplicity. In reference to FIGS. 4, 5 and 6, the sink 100 is generally formed as a rectangular basin sink that includes a basin 120. Although a single, basin 120 is shown, more than one basin may be included in the sink 100 and separated from one or more adjacent basins by a divider wall (not shown). The basin 120 is surrounded by a front wall 122 (shown in FIG. 3), a back wall 124, two sidewalls 126 and a floor 128 that includes a drain opening 130.

As can be seen from FIG. 5, the sink 100 may be fabricated from steel sheet, for example, stainless steel, as a unitary structure that includes welded and/or drawn portions. In the illustrated embodiment, the basin 120 along with the front wall 122, the back wall 124, the two sidewalls 126 and the floor 128 can be formed by a single, drawn sheet of steel into a box-shape having an open top. The top flange 112, along with the apron 212 and the shelf 214 can be formed by a single sheet of steel that has a basin opening punched into it along an opening 132 and is also bent to a desired shape to form the top flange 112, the apron 212 and the shelf 214. The walls surrounding the basin 120 can then be welded to the top flange 112 along the 132 that surrounds the basin to form the sink 100. The welded seam can be rounded and ground to a desired finish so the sink 100 appears continuous along the seam between the basin and the top flange.

Figure 7:
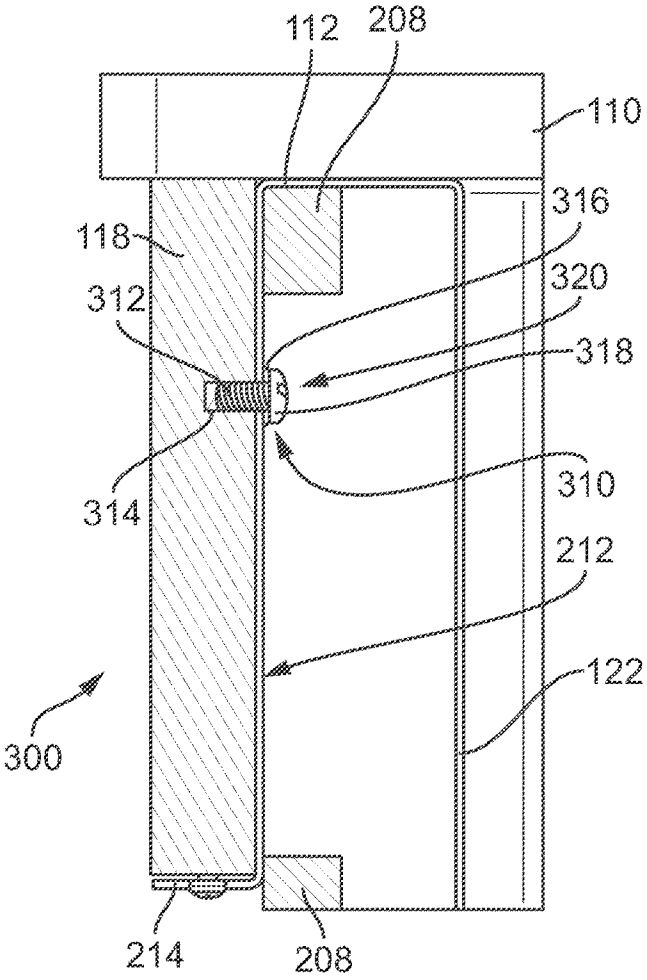

The sink 100 advantageously includes a fastening system 300 to removably attach the replaceable panel 118 onto the apron 212 and/or shelf 214 so that the replaceable panel 118 can be replaced without removing the sink 100 or adjusting any of the plumbing or drain connections. In the illustrated embodiment, the fastening system 300 includes cooperating fasteners with openings in the sink. More specifically, as shown in FIG. 6 with the replaceable panel 118 removed, the apron 212 includes two key openings 304, each of which includes a central opening 306 and two slots 308 extending horizontally on either side of the central opening 306. The central opening 306 is sized to accept therethrough the head of a fastener 310, shown in the cross section of FIG. 7. For securing the replaceable panel 118 to the apron 212, the fastener 310 is installed into the back side of the replaceable panel 118 such that a threaded portion 312 of the fastener 310 threadably engages a threaded opening 314 formed in the backside of the replaceable panel 118. A spring washer 316 such as a Belleville washer is inserted along the body of the fastener 310 and disposed between a head 318 and a rear surface of the apron 212. A feature 320 such as a slot is formed in the head 318 of the fastener to allow its tightening and loosening.

Figure 8:
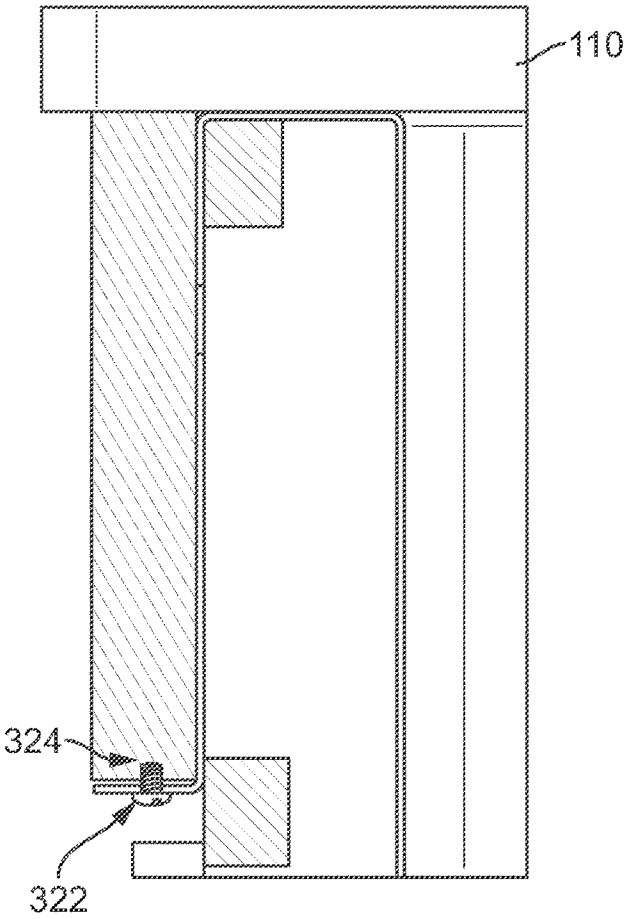
FIGS. 7 and 8 are enlarged, detailed views of the sink of FIG. 1 in its installed position.

When installing the replaceable panel 118, the fastener 310 and spring washer 316 are loosely secured to the back side of the replaceable panel 118 before inserting the head 318 of the fastener 310 and also the spring washer 316 through the central opening 306 of the apron 212. This can be done twice, once on either side of the apron 212. The replaceable panel 118 along with the two fasteners 310 inserted through their corresponding central openings 306 are then slid along the sink 100 such that the bodies of the respective fasteners travel along the corresponding slot 308. The thickness of the apron 212, which is now disposed between the head 318 and the rear face of the apron 212 causes the spring washer 316 to compress and maintain a clamping force between the replaceable panel 118 and the apron 212 of the sink 100. To secure the replaceable panel 118 and prevent sliding when the replaceable panel 118 is at its final position relative to the sink, two retaining screws 322 can be inserted into mating threaded openings 324 at the bottom face of the replaceable panel 118 through corresponding holes 326 formed in the shelf 214, as shown in FIG. 8.

As can be appreciated, the process to remove the replaceable panel 118 from the sink 100 for replacement can be the reverse of the installation procedure. For removing the replaceable panel 118, the two screws 322 can be removed and the replaceable panel 118 slid along the slots 308 in the apron 212 such that the fasteners 310 move towards their respective central openings 306. When the spring washers 316 and corresponding heads 318 of the fasteners 310 are aligned in the central openings 306, the replaceable panel 118 can be removed and replaced with a different replaceable panel 118.

The fastening system 300, while described relative to fasteners and spring washers can be embodied in different configurations. For example, the fasteners can be replaced by hooks that engage slots formed in the apron, or with slots formed in the replaceable panel that engage rails protruding from the front surface of the apron 212. Moreover, while the sink 100 can be made of stainless steel, it can be constructed with other metals or materials including composite materials such as engineered stone. The replaceable panel can be made from any desired material such as quartz (natural or man-made), ceramic, plastic, fiber-reinforced plastic (e.g., carbon fiber), other composite materials, canvas, leather, glass, a tiled substrate, porcelin, a translucent material, stainless steel, other metals, or wood, which can be solid or veneered wood, and the like. The panel including paint, plastic coating(s), plastic wrapping(s), powder coating or other treatments. Further, while the replaceable panel 118 is shown having a smooth finish, it can include any type of finish and/or include a relief design. The replaceable panel may also be made from two or more connected structures and may include components such as lights (LEDs), electronic displays, speaker elements (e.g., Bluetooth-enabled), and the like. The above alternatives may be applied to any or all of the sink embodiments disclosed herein.

Figure 9:
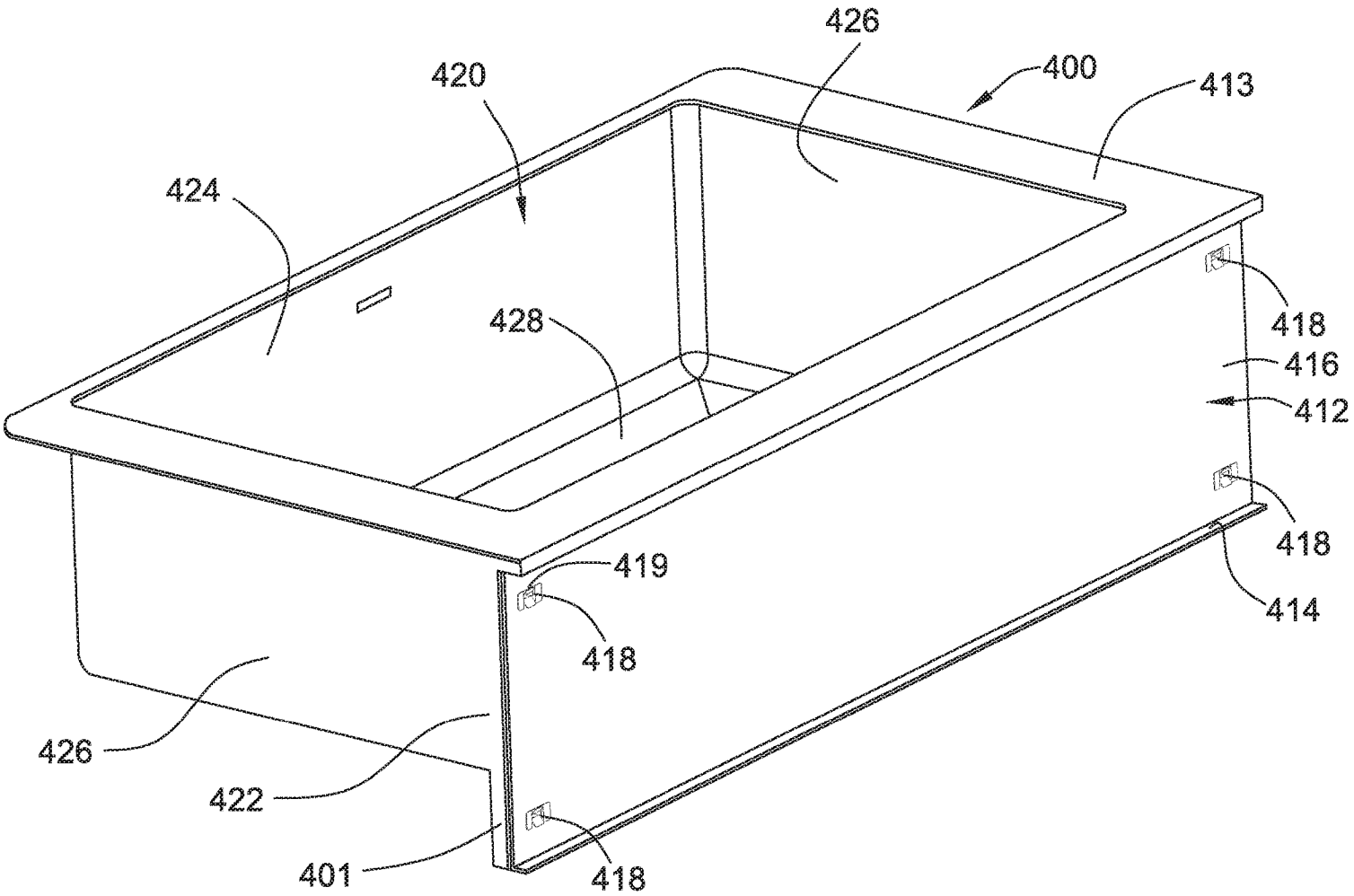
FIG. 9 is a perspective partial view of a sink in accordance with an embodiment of the disclosure.
Figure 11:
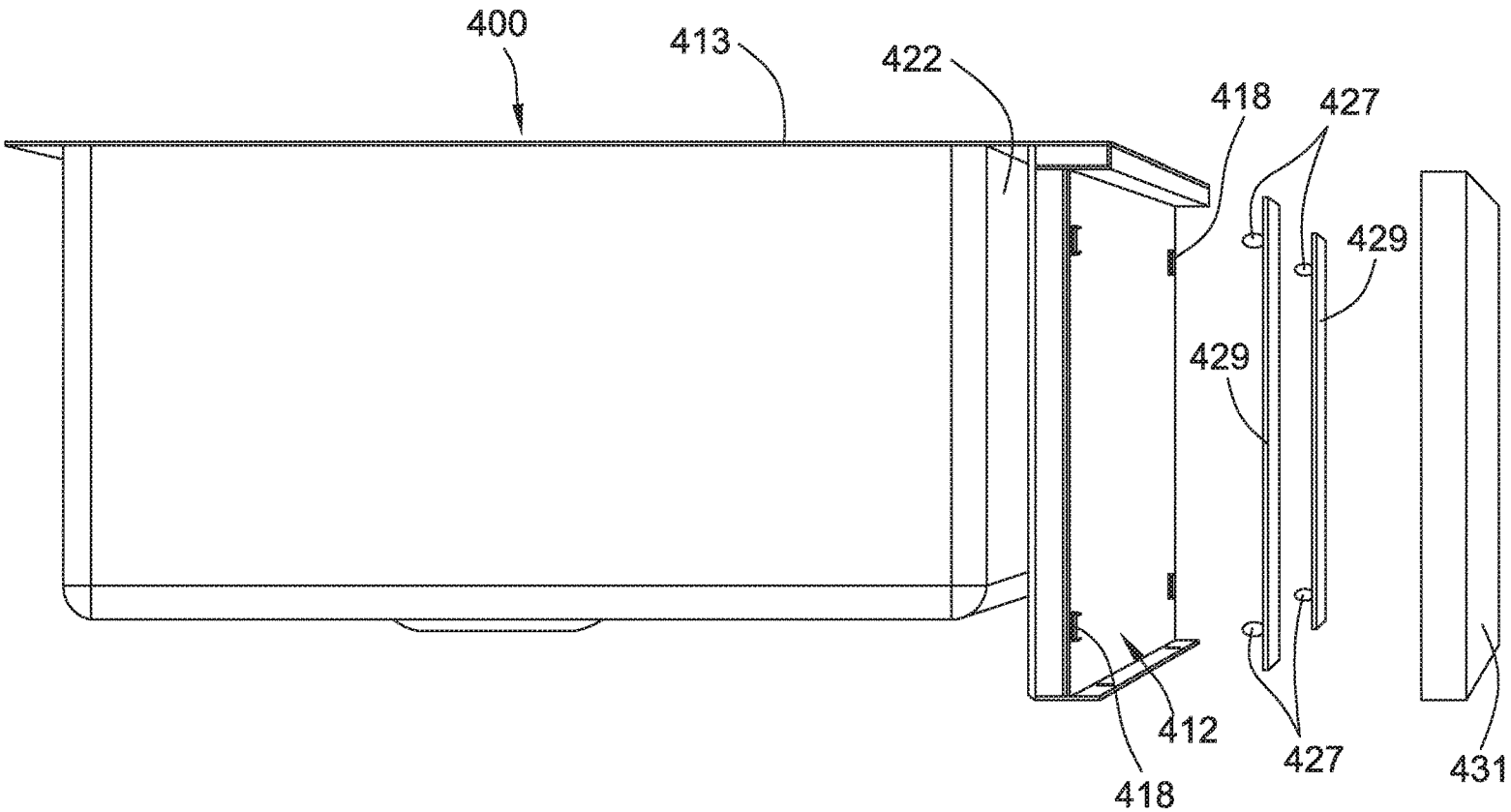
FIG. 11 is an exploded perspective view of a sink, fastening system, and replaceable panel according to the embodiment of FIG. 9.
Figure 12:
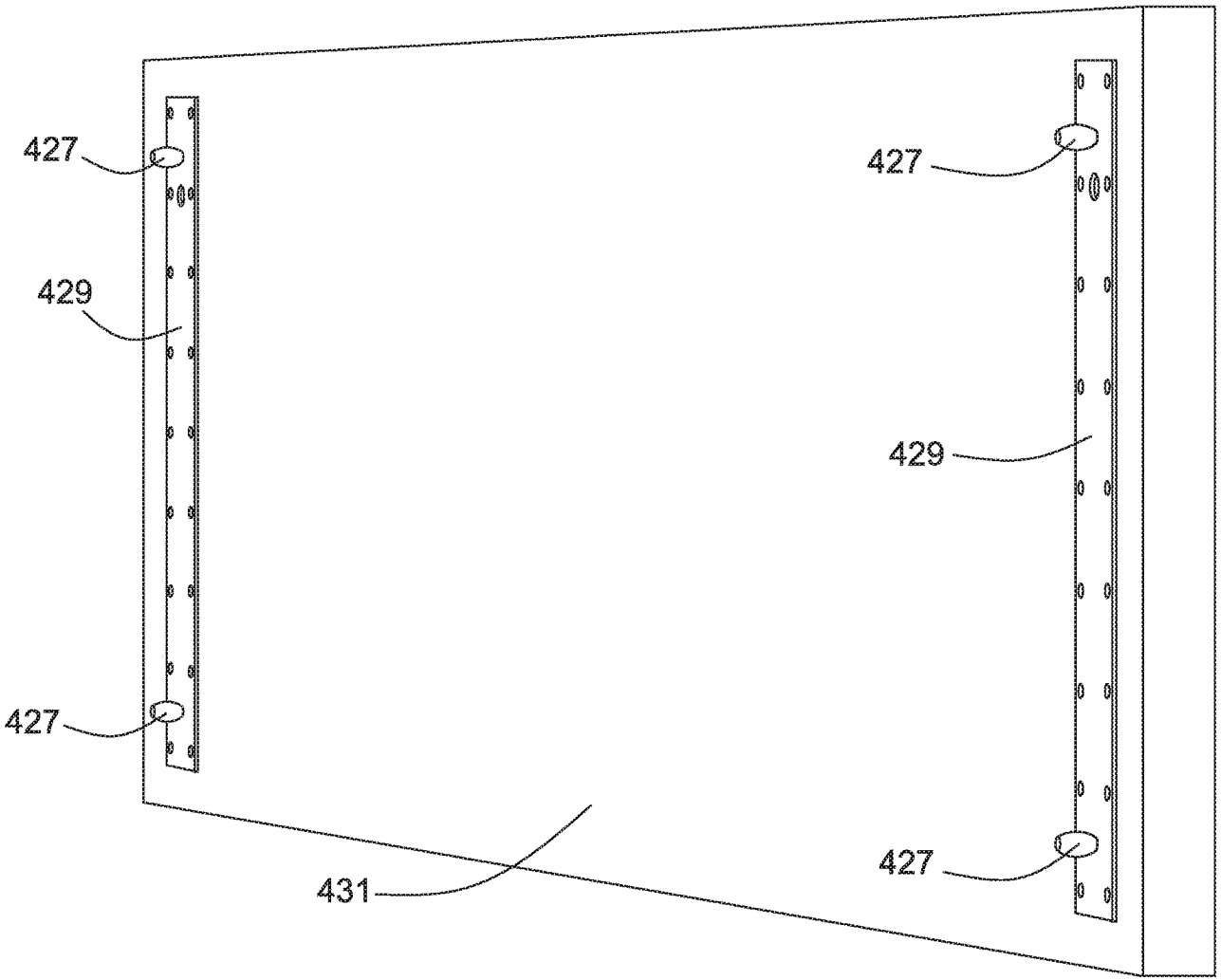
FIG. 12 is a perspective view of a replaceable panel and stud fastener assembly according to the embodiment of FIG. 9.
Figure 13:
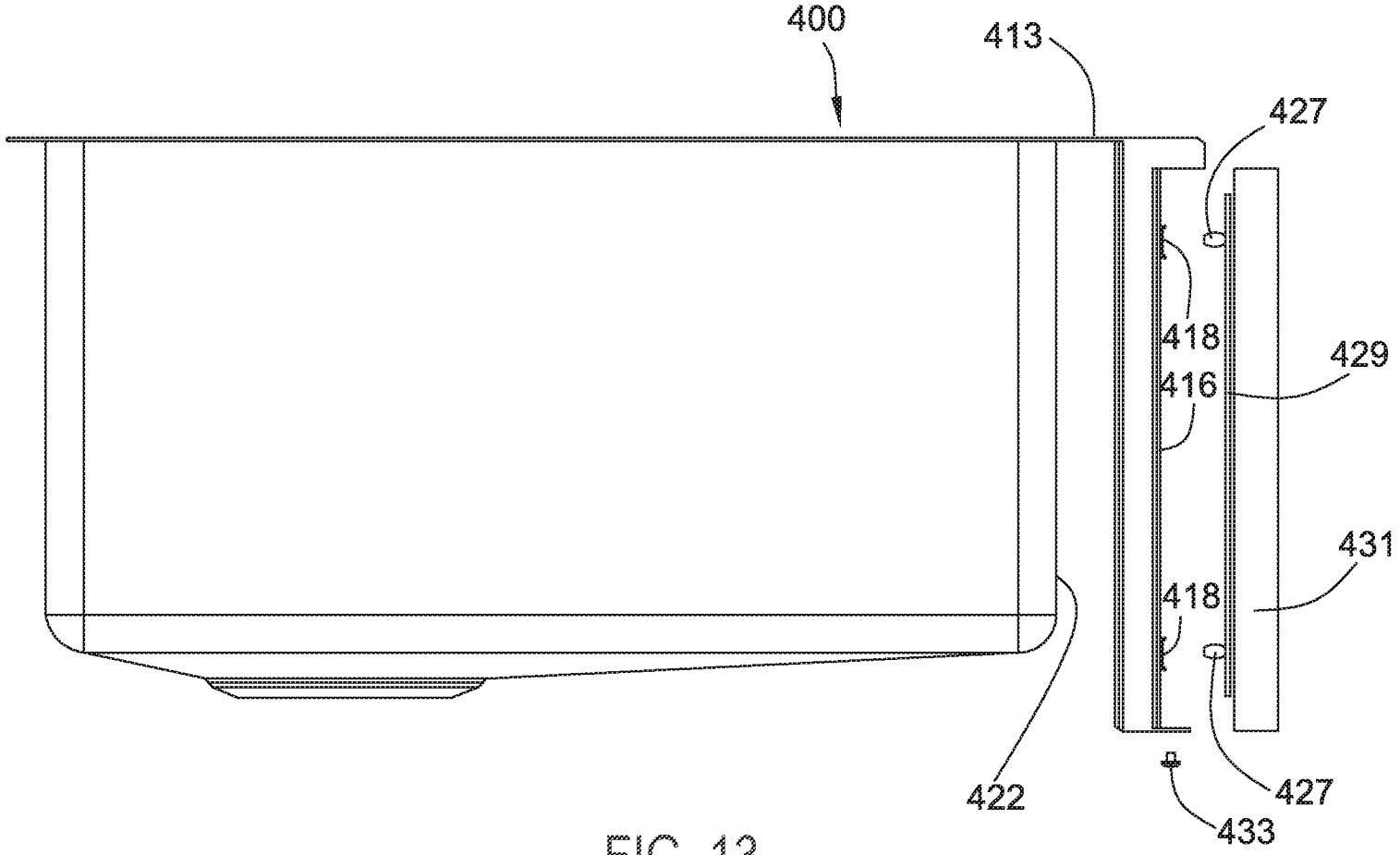
FIG. 13 is an exploded side view of a sink, fastening system, and replaceable panel according to the embodiment of FIG. 9.
Figure 14:
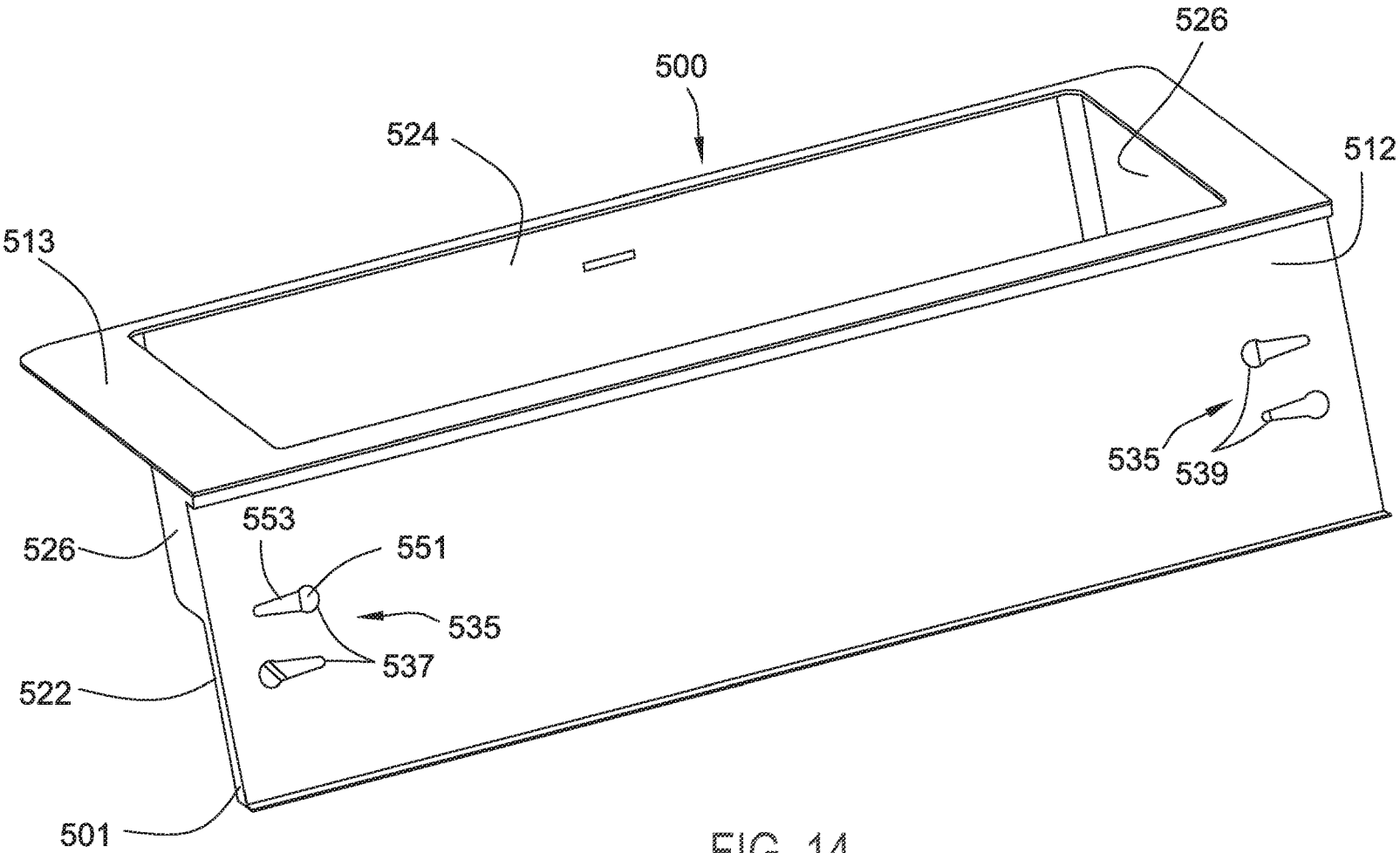
FIG. 14 is a perspective partial view of a sink in accordance with another embodiment of the disclosure.

Turning to the embodiment of FIGS. 9, 11, and 13, a sink 400 is generally formed as a rectangular basin sink that includes a basin 420. Although a single basin 420 is shown, more than one basin may be included in the sink 400 and separated from one or more adjacent basins by a divider wall (not shown). The basin 420 is surrounded by a front wall 422, a back wall 424, two sidewalls 426 and a floor 428 that includes a drain opening 430 (FIG. 11). The sink 400 may be surrounded by a top flange 413 that may be shaped and sized to rest atop a countertop (not shown) or underneath a countertop and atop a cabinet (not shown).

The sink 400 may be formed with an apron 412 integrated into the front wall 422 as shown in FIG. 9, or the front wall 422 may include an apron that may be attached to the top flange 413 in a configuration that is spaced apart from the front wall as shown in FIGS. 11 and 13. It will understood that the construction of a cabinet that is configured to receive one of the two sinks will be adapted to fit to the construction of the sink 400.

The sink 400 of FIG. 9 includes a front wall 422 that includes a extension 401 that extends, in a planar manner, to a point having a lower elevation relative to the sink floor 428. The front wall 422 is therefore configured to receive and support the full height and width of the apron 412.

The apron 412 may include a rectangular front face 416 facing outwardly relative to the sink 400 and a shelf 414 that extends horizontally away from the apron. The apron 412 may include a plurality of stud-receiving spring clips 418, that are configured to reside in openings 419 in the apron. The openings 419 may be rectangular sockets formed in the apron 412 and optionally also the front wall 422.

Figure 10:
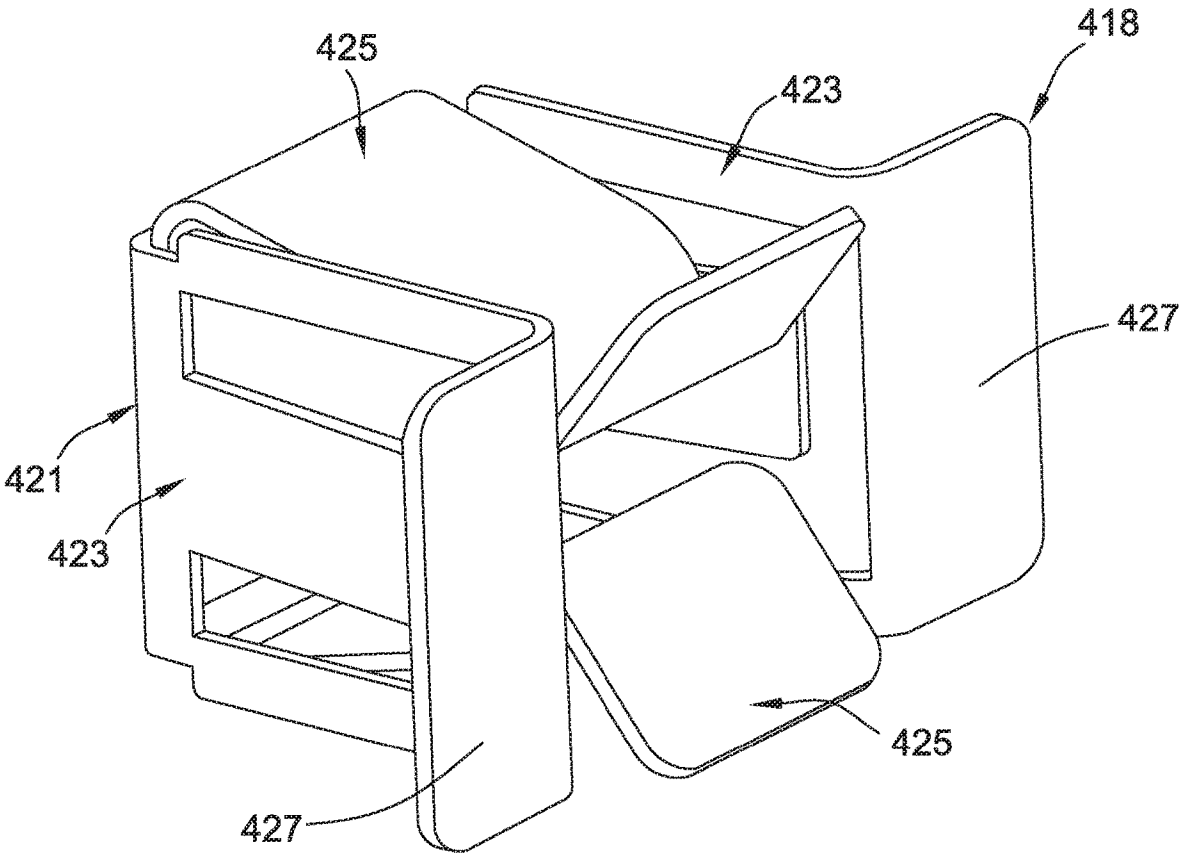
FIG. 10 is a perspective view of a clip for releasably retaining a stud according to the embodiment of FIG. 9.

The clips 418, which are shown in detail in FIG. 10, each include a base 421, and a pair of opposed seating arms 423 and a pair of spring arms 425 attached to the base. The clips 418 may be formed of any suitable material, such as metal or plastic. The size and shape of the clip 418 is configured such that each clip fits into one of the openings 419. The seating arms 423 may be a pair of arms arranged opposite each other, each arm including a flange 427 that fits flush in contact with outside surface of the apron 412 surrounding the opening 419 and operates to stops the depth of the clip. The spring arms 425 are configured to resiliently spread to accept and close to an initial position to retain a stud, such as a ball stud 427 (FIG. 11). The ball stud 427 may be a projection that is circular, ovoid, knob-like, elongate, barrel, button, or bead-shaped, rounded or a similar shape configured to spread the spring arms 425 when inserted therebetween and then be retained by the spring arms when fully inserted wherein the spring arms are permitted to close together behind the stud.

The ball studs 427 may be formed on or attached to a plate 429 that itself is attached, by any suitable fastener, such as screws, nails, adhesive, and so on, to a replaceable panel 431. Alternatively, the ball studs 427 may be attached directly to the replaceable panel 431. Each plate 429 may be a planar metallic or plastic composite body, or made of any suitable material. In one embodiment, each one of a pair of spaced plates 429 includes a spaced pair of ball studs 427.

The replaceable panel 431 may be made of natural or artificial wood, composite materials or any suitable material as detailed above. In the illustrated embodiment, the positions of the ball studs 427 may be such that the panel 431 may be installed in any orientation be inserting each ball stud in a respective clip 418 so as to position the panel in a visually and/or functionally desired orientation. After the panel 431 is secured in position, one or more retaining fastener 433, such a screw, may be installed into a side of the panel through the shelf.

The embodiment of FIGS. 11 and 13 differs from the embodiment of FIG. 9 in that the apron 412 is spaced apart from the sink 400 to the extent necessary for a frame member of a cabinet to fit therebetween (not shown), for example. The attachment of the panel 431 may be according to the embodiment of FIG. 9.

Figure 15:
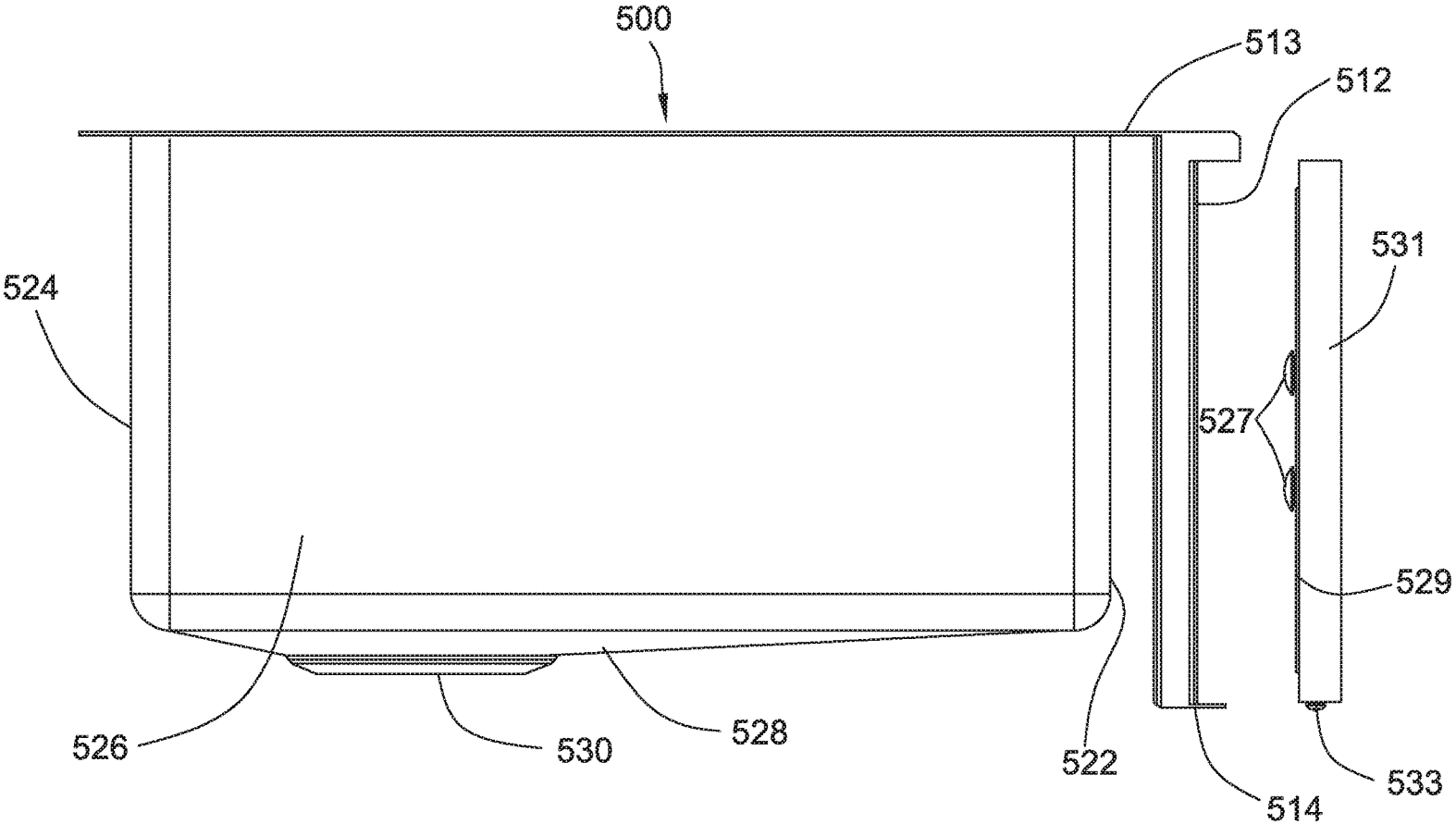
FIG. 15 is an exploded side view of the sink, fastening system, and replaceable panel according to the embodiment of FIG. 14.

FIG. 14-17 show yet another embodiment of a sink 500 with a replaceable panel 531 (FIG. 15). The sink 500 is similar in construction to that of FIG. 9, with a stud and stud-receiving structure to attach the replaceable panel 531 to the apron 512 of the sink.

A sink basin 520 is surrounded by a front wall 522, a back wall 524, two sidewalls 526 and a floor 528 that includes a drain opening 530 (FIG. 15). The sink 500 may be surrounded by a top flange 513 that may be shaped and sized to rest atop a countertop (not shown) or underneath a countertop and atop a cabinet (not shown) as is well-known.

The apron 512 includes stud-receiving structures, which may be in the form of directional keyholes 535 formed therethrough that are configured to secure a replaceable panel 531 (FIG. 15) thereto. The keyholes 535 include a first pair of keyholes 537 adjacent a first side of the apron 512 and a second pair of keyholes 539 adjacent a second side of the apron. The apron 512 may be supported along its height and width by front wall 522 and by an extension 501 that extends from the front wall. Alternatively, the apron 512 may be spaced from the front wall 522 as shown in FIG. 15 by attachment to the flange 513 as in the above described embodiment.

The keyholes 537, 539 each have an opening 551 and a slot 553 extending from the opening. The opening 551 has a greater diameter than the slot 553. The slot 553 may taper by narrowing away from the opening 551. In some embodiments, the keyholes are oriented horizontally as in FIG. 14, and in other embodiments oriented vertically.

The opening 551 of the upper one of the first pair of keyholes 537 is positioned radially inwardly from the slot 553 and may be generally circular with a size and shape that is configured to receive a button stud 527 therethrough (FIG. 15). The slot 553 is sized and shaped to retain the button stud 527 in the slot. Securement of the button stud 527 occurs by inserting the button stud into the opening 551 and sliding the button stud into the slot 553 of the keyhole. The slot 553 may be tapered such that the button stud 527 is held more tightly as a function of distance traveled into the narrowing slot away from the opening 551. In the example illustrated in FIG. 14, the keyhole 537 in the upper position receives a button stud 527 in the opening 551 and as the button stud is moved horizontally toward the left into the slot 553 (as oriented in the figure) the button stud is held more tightly as the stud enters the narrowing slot.

A lower one of the second pair of keyholes 539 has the same configuration and orientation as that of the upper one of the first pair of keyholes 537. A replaceable panel 531 that is to be installed horizontally onto the apron 512 by sliding the panel from the right direction and secured by moving the panel to the left (as oriented in the figure) will have button studs 527 that are positioned on the panel such that one of the button studs aligns with the lower one of the second pair of keyholes 539 and the other one of the button studs aligns with the upper one of the first pair of keyholes 537.

A panel 531 that is to be installed onto the apron 512 by sliding the panel from the left and secured by moving the panel to the right (as oriented in the figure) may have button studs 527 that are positioned on the panel such that one of the button studs aligns with the upper one of the second pair of keyholes 539 and the other one of the button studs aligns with the lower of the first pair of keyholes 537. This is made possible by reversing the orientation of the openings 551 and slots 553. In other words, the upper one of the first pair of keyholes 537 has the same configuration as the lower one of the second pair of keyholes 539 and the lower one of the first pair of keyholes is reversed from the upper one of the first pair and has the same configuration as the upper one of the second pair of keyholes. Accordingly, the panel 531 may be installed from either the left or right side of the sink 500, which increases installation options of the sink. Advantageously, when the sink 500 is installed against a wall or other barrier structure on one side of the sink, the panel 531 may be installed from the accessible other side of the sink.

Figure 16:
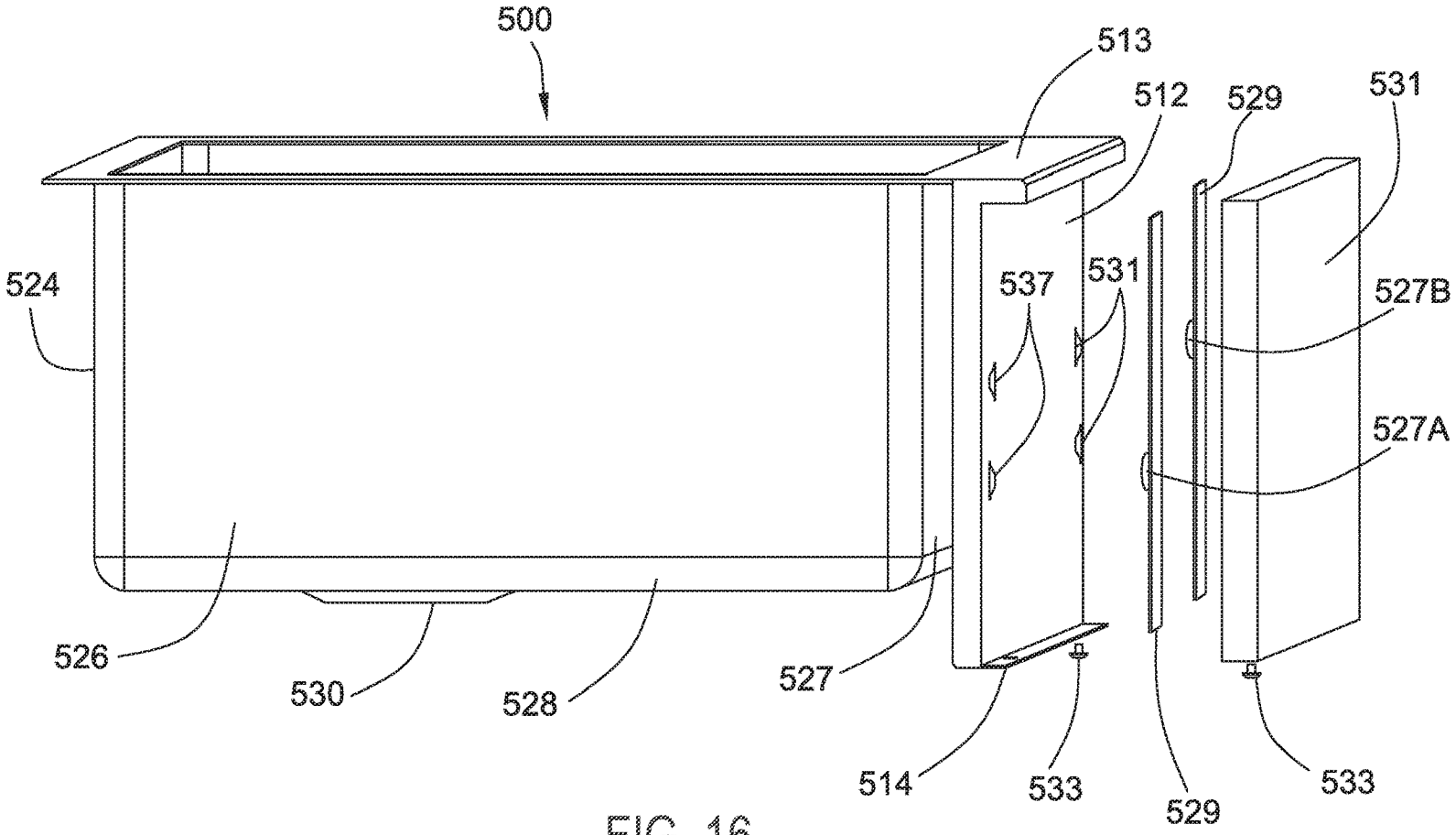
FIG. 16 is a perspective view of a replaceable panel and stud fastener assembly according to the embodiment of FIG. 14.
Figure 17:
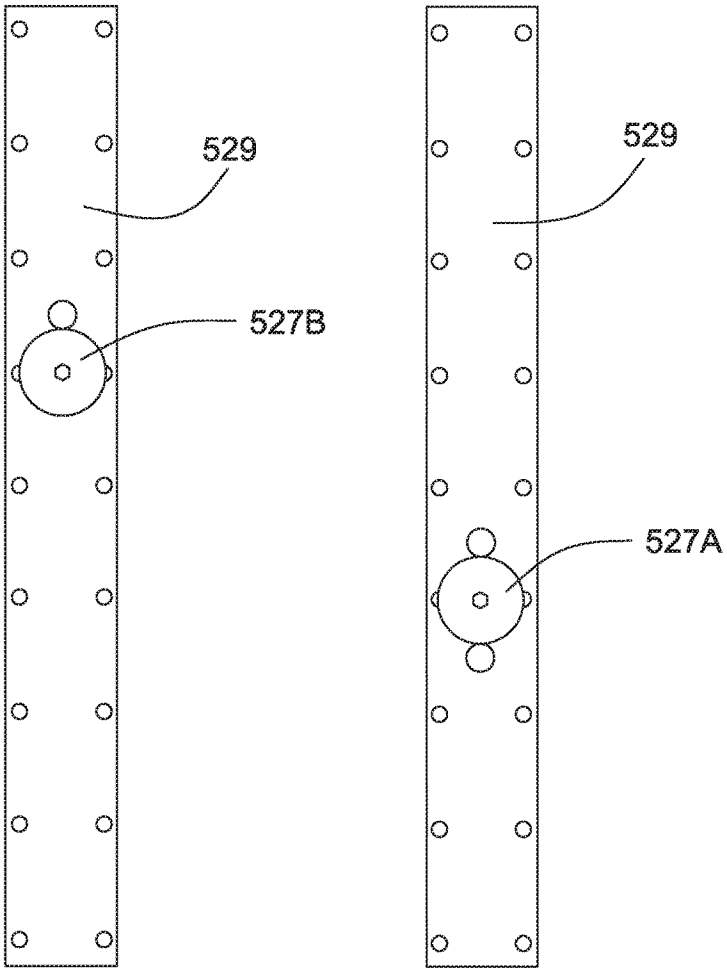
FIG. 17 is a front view of a stud fastener assembly according to the embodiment of FIG. 14.

Referring to FIGS. 15-17, the button studs 527 may be attached to the panel 531 or attached to a plate 529 that itself is attached to the replaceable panel. When the panel 531 is secured to the apron 512, fasteners 533 may be used to prevent the panel from moving relative to the apron and sink 500.

In the configuration shown in FIG. 16, the leftmost button stud 527A is positioned on the panel 531 to engage the lower of the two keyholes 537 and the rightmost button stud 527B is positioned on the panel to engage the upper one of the two keyholes 539. Securement of the buttons 527A/B and thus the panel 531 proceeds by insertion of the buttons into the openings 551 of respective keyholes 537, 539 and sliding the panel from left to right (as in the figure) to slide the buttons into the tapered slots 553. In the case where the panel 531 needs to be inserted from right to left, the arrangement of the fastener buttons 527 are reversed and the alternative pair of keyholes 537, 539 are utilized.

Figure 18:
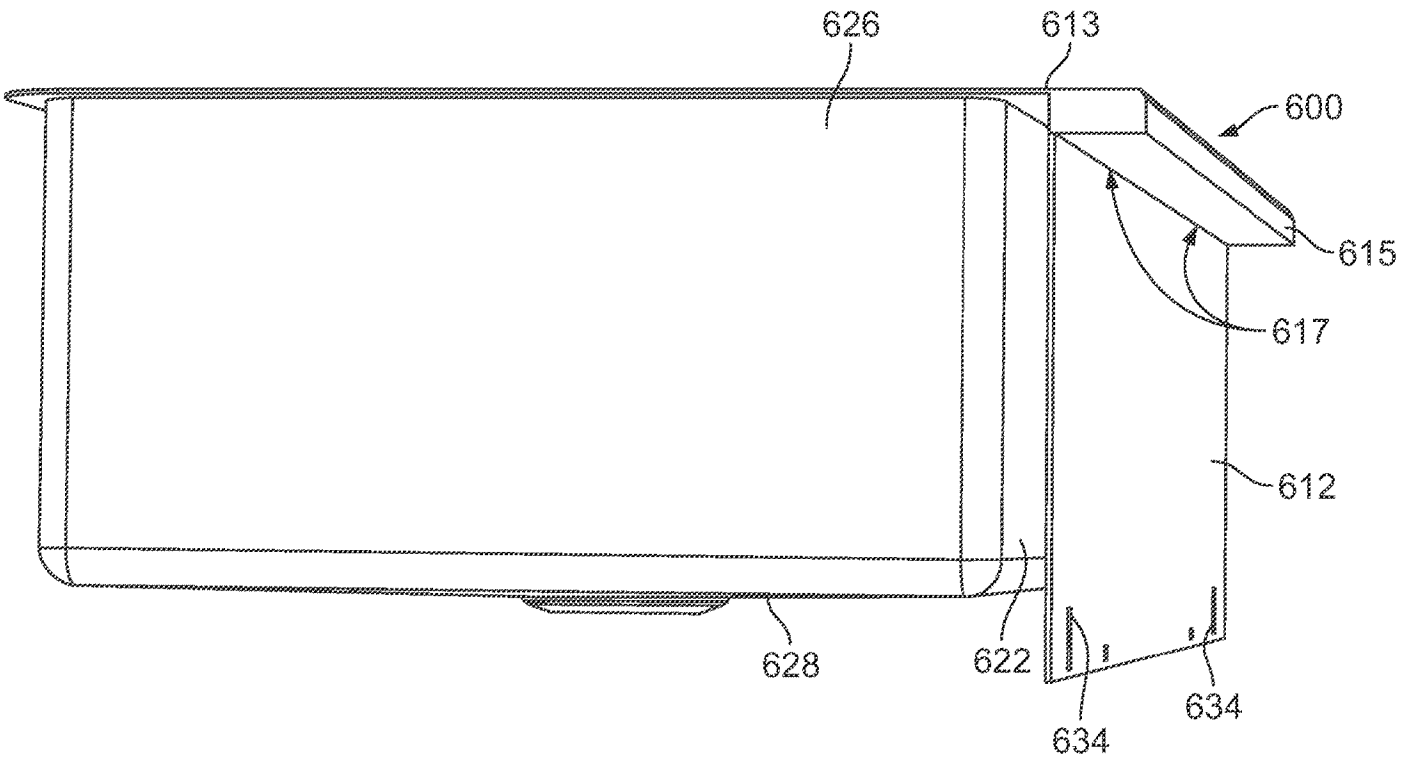
FIG. 18 is a front, lower, left perspective view of a sink and apron according to another embodiment of the disclosure.
Figure 19:
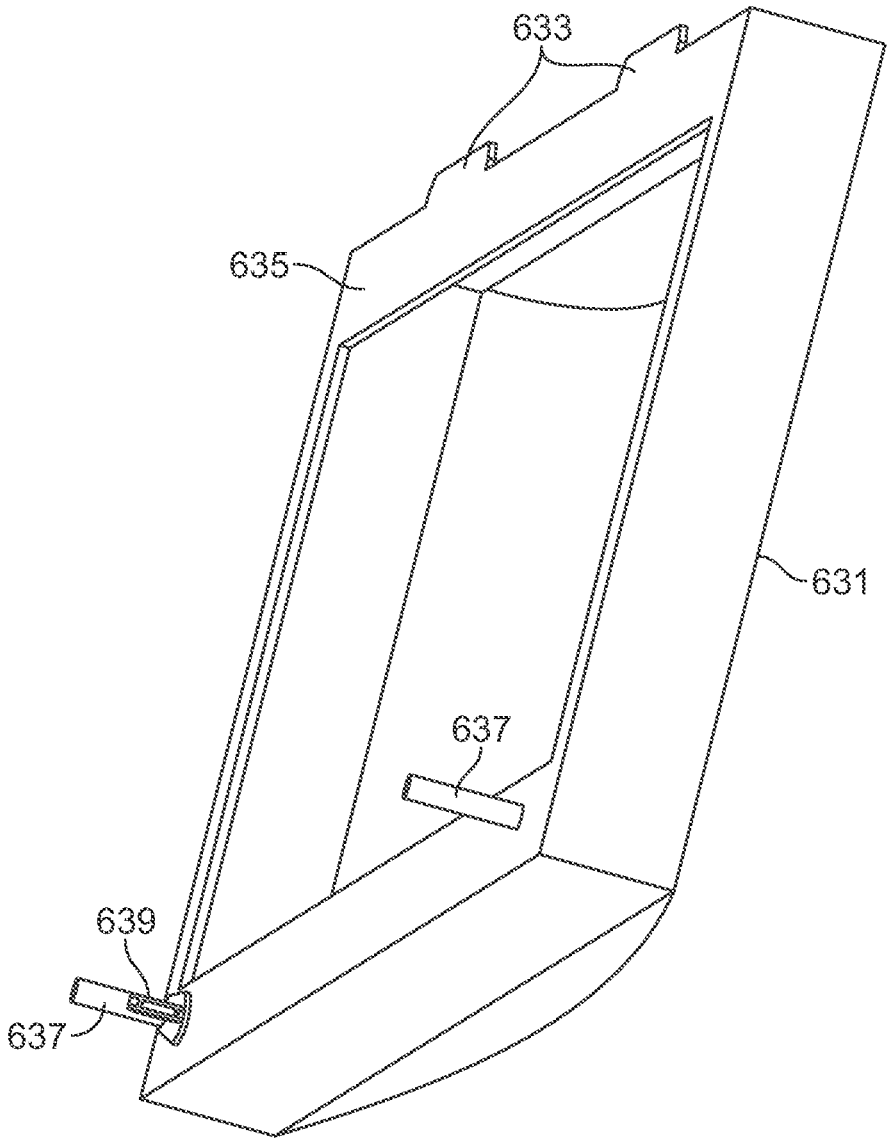
FIG. 19 is a rear, lower, left perspective view of a sink panel.
Figure 20:
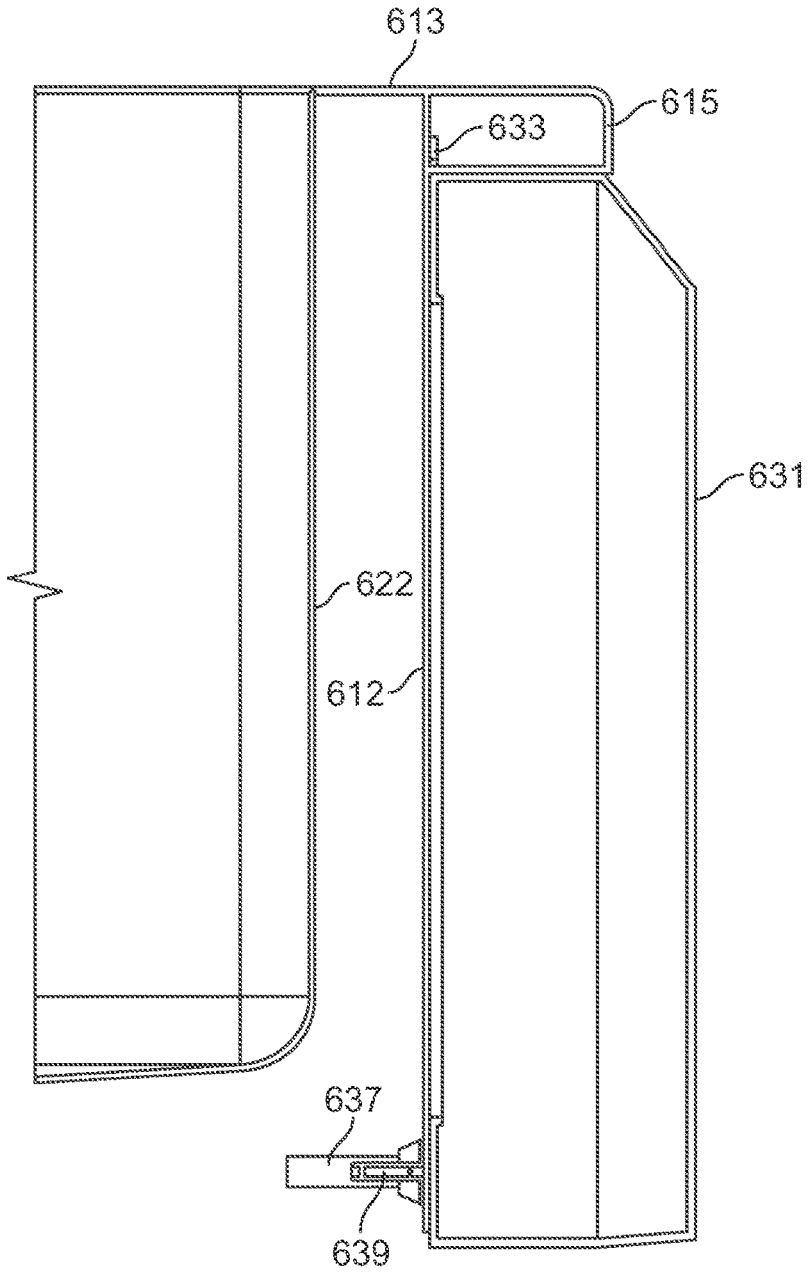
FIG. 20 is a side, sectional view of the sink and apron of FIG. 18 with the panel of FIG. 19 assembled thereto.
Figure 21:
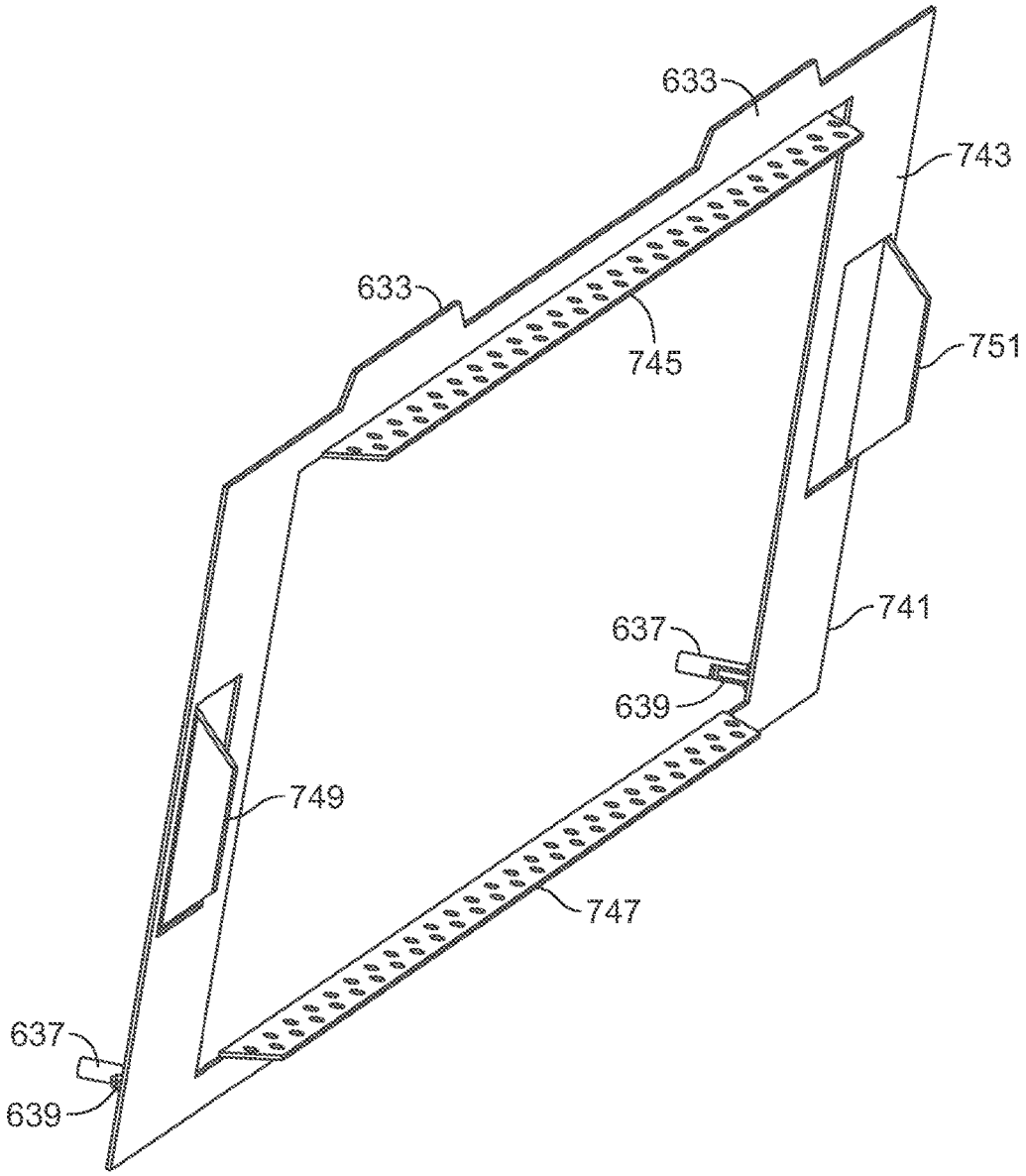
FIG. 21 is a front, upper, left perspective view of an adapter plate for the sink and apron of FIG. 18.

A further embodiment is shown in FIGS. 18-20. FIG. 18 shows the front portion of an apron-front sink 600, which has the same construction as previously disclosed sink basins, and includes a bottom wall 628 and one sidewall 626. The sink 600 includes a front wall 622, from which a vertically-oriented apron 612 is spaced and supported by a flange 613. The flange 613 includes an extension portion 615, which may be shaped as a bullnose, that extends forwardly from the sink 600. Alternatively, the extension portion 615 may be considered an extension of the apron 612. The extension portion 615 can include a pair of spaced slots 617 on an underside thereof. The pair of slots 617 may number one or more than one slots. The slots 617 may be formed in the bullnose portion 615 of the flange 613 at or near the junction between the flange and the apron 612.

In one embodiment, the slots 617 are each configured to vertically, upwardly receive a tongue, tab, or similar element of a panel 631. Alternatively, the slots 617 may be formed in the apron 612 to horizontally receive a tongue, tab, hook, or similar feature formed on or attached to the panel. The apron 612 may also include openings, holes or slots 634, for receiving therethrough structural features of the panel 631.

The panel 631, turning to FIG. 19, may be a generally rectangular, hollow housing. The panel 631 may be formed of metal or any suitable material as set out above. A panel 631 made of sheet metal, such as stainless steel, will be relatively lightweight and therefore should require a simple attachment method or structure.

For example, the panel 631 may includes a pair of spaced tabs 633 that extend upwardly from a top rear surface 635 of the panel. The tabs 633 are shaped and sized to be slidably received within the slots 617 of the sink 600 to hold the panel 631 onto the apron 612. The rear surface 635 may also include a pair of spaced studs 637 adjacent a bottom of the panel 631. The studs 637 may be threaded. The studs 637 are shaped and sized to be received through the openings 634. As seen in FIG. 20, a fastener 639, such as a nut, wing nut, clip, or other fastener capable of being held on a stud, threaded or otherwise, fastens the panel 631 on the apron 612 after the tabs 633 are slid upwardly into the slots 617. If the openings 634 are elongate, the tabs 633 of the panel 631 are slid upwardly into the slots 617 and the studs 637 are passed through the openings. The fasteners 639 are fixed onto the studs 637 to retain the panel 631 on the apron 612.

Turning to the embodiment of FIGS. 21-24, the sink 600 may include an adapter plate 741. The adapter plate 741 is configured to hold a panel 731 that is heavier than a sheet metal version, such as those constructed of stone, stone composites, and other substantially heavier and/or thicker constructions. The adapter plate 741 includes a rectangular plate body 743 that is shaped and sized to attach to the apron 612 and shaped and sized to support panel 731.

Specifically, the adapter plate 741 includes tabs 633, studs 637, and fasteners 639, which are configured as in the embodiment of FIGS. 18-20, such the adapter plate is attachable to apron 612 without any further modifications to the sink 600 and apron. The adapter plate 741 also includes an upper bracket 745 and a lower bracket 747 that extend horizontally from the adapter plate and outwardly from the apron 612, when installed. The adapter plate 741 also includes left and right vertical brackets 749, 751, adjacent outer edges of the adapter plate.

The adapter plate 741 may be a single piece construction with the brackets formed or punched from the material itself, or of multipiece construction with the brackets welded or otherwise fixed thereon. The adapter plate 741 may be made of a metal material, plastic, composite or any suitable material. For strength, the adapter plate 741 may be a rectangular sheet of material or may in the form of a "picture frame" with a central opening to reduce weight and material. In one embodiment, the left and right brackets 749, 751 are near the outer edges of the adapter plate frame and the upper and lower brackets 745, 747 are near the inner edges of the adapter plate frame.

Figure 22:
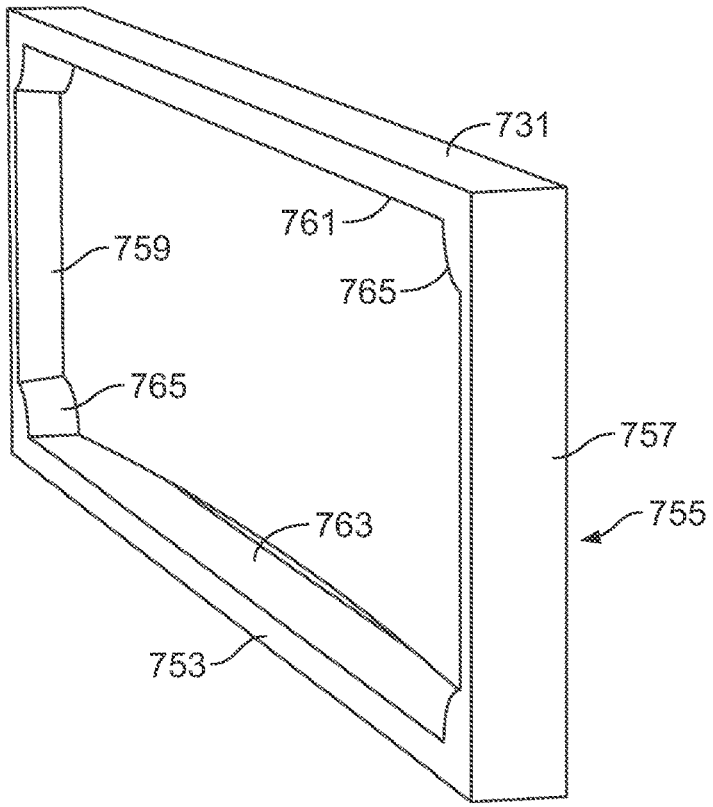
FIG. 22 is a rear, upper, left perspective view of a panel for attaching to the adapter plate of FIG. 21.
Figure 23:
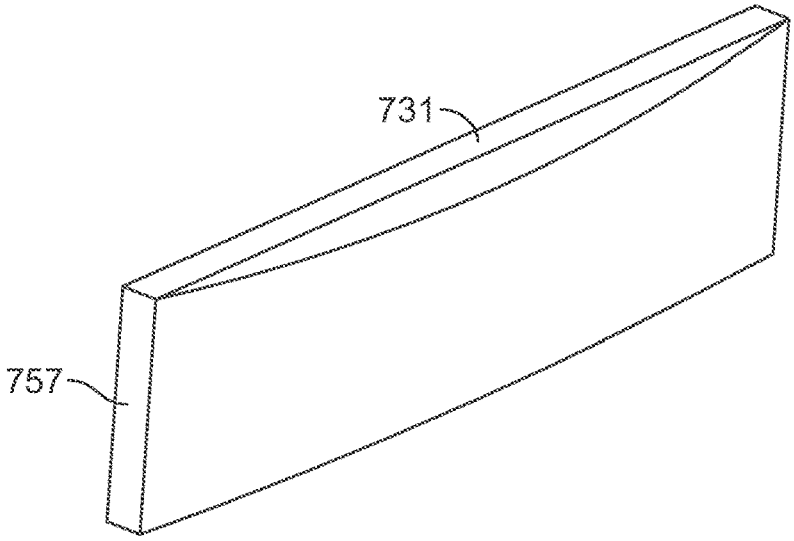
FIG. 23 is a front, upper left perspective view of the panel of FIG. 22.
Figure 24:
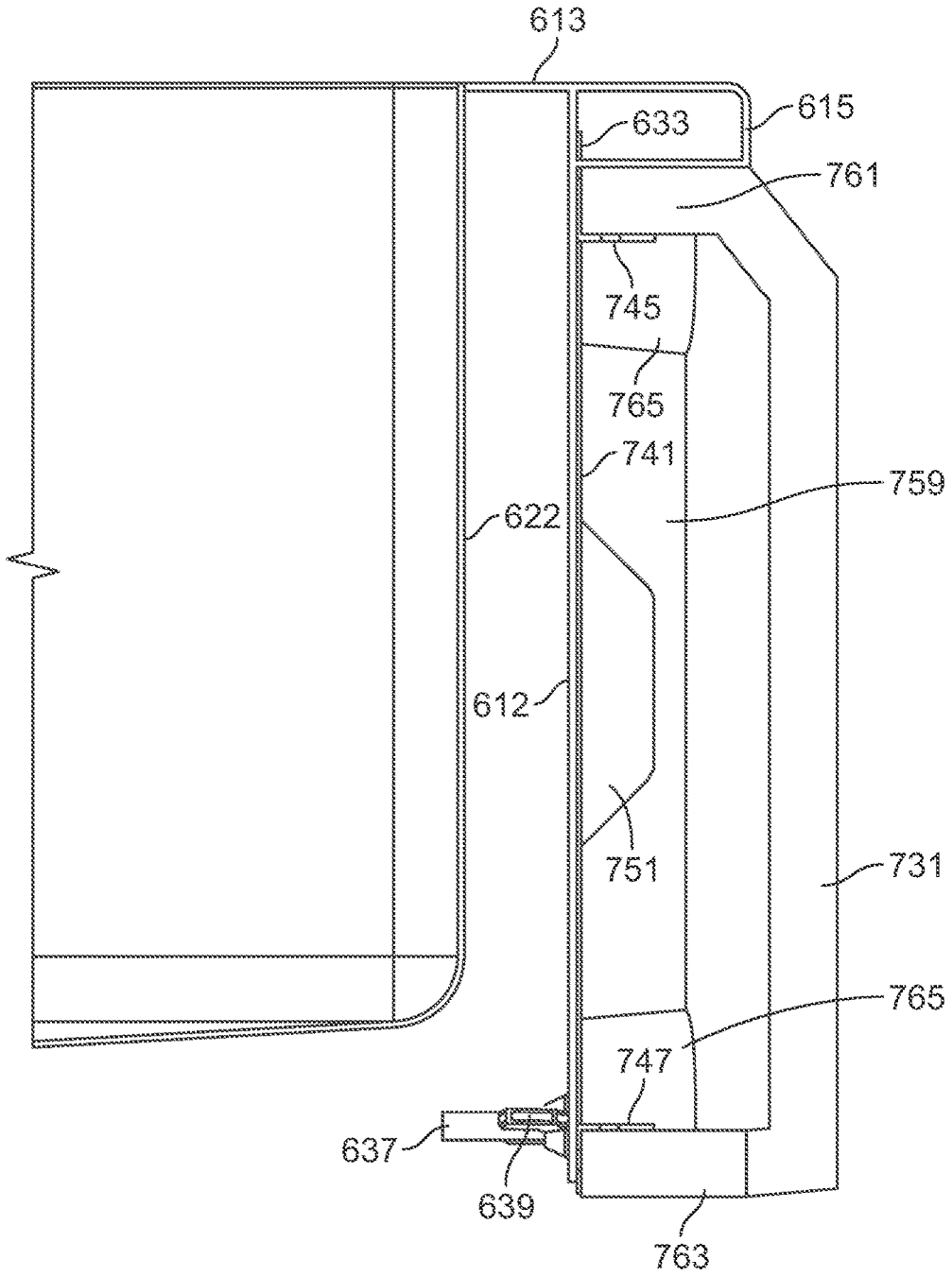
FIG. 24 is a side, sectional view of the sink and apron of FIG. 18 with the adapter plate of FIG. 21 and panel of FIG. 23 assembled thereto.

In FIG. 22, the panel 731 is an example of a stone or stone composite construction. The thickness of the panel 731 is such that an appropriate amount of support is provided to the panel based on the nature of the material, which may be relatively thick because it may be more fragile or breakable than a sheet metal version. The panel 731 may be hollowed out or relieved in the back side 753 facing the sink 600 to reduce weight. The panel 731 may be shaped to provide four sidewalls 755, a left sidewall 757, a right sidewall 759, an upper sidewall 761, and a lower sidewall 763. When installed to the adapter plate 741, by a silicon adhesive, for example, the left sidewall 757 is held by the left bracket 749 and the right sidewall 759 is held by the right bracket 751. The brackets 749, 751, 745, 747 may be interior to the sidewalls 755 when assembled. The intersections of the sidewalls 755 may include extra material in the form of convex quarter-rounds 765 or other shapes that provide reinforcement to the panel corners and avoid stress risers.

It will be appreciated that a variety of fastening devices, assemblies, materials, and methods may be used to fasten a panel (e.g., element 531) to a sink such as that disclosed herein and that one or more methods may be used in combination. For example, the panel may be attached to one of an apron (e.g., element 512) or the front wall of the sink with an adhesive material. The adhesive may be applied to the panel and the apron at an upper end and/or lower end thereof to adhere the panel to the apron or the front wall. Also, adhesive may be applied to the panel at a top side of the panel and an underside of a sink flange or similar horizontal structure extending from the apron. The adhesive may be a suitable glue or tape, such as double-sided adhesive tape. The panel may be fixed similarly to the sink or apron with hook and loop fastener material. The adhesive and/or fastener material may be of a type that permits the panel to be released from the element to which it is attached, for example, with an application of heat and/or force to permit the substitution of a different panel for the existing panel and thereby a modification of the sink structurally, functionally, and/or ornamentally can be performed.

A panel may be attached to one of an apron (e.g., element 512) or the front wall of the sink with one or more magnets. The magnets may be attached to one or both of the panel and the apron at an upper end and/or lower end thereof to magnetically attach the panel to the apron or the front wall of the sink. In embodiments where one or more magnet is attached to only one of the panel or the sink, the other of the panel or sink may include a ferromagnetic material so as to provide magnetic attraction between the magnet and the ferromagnetic material. The one or more magnet may be applied to the panel at a top side of the panel and/or an underside of a sink flange or similar structure extending from the apron.

The panel may be suspended from the top and front of the sink by a structural hook element, e.g., as a curved hook or hanger shape, which is sized and shaped to engage a correspondingly shaped top or front element of a sink and thereby suspend the panel from the sink. The hook element may be arcuate or angular and may be formed as a unitary, single-piece construction with the panel or may be a separate part attached thereto. The assembly of the sink and panel with hooking elements may include a spacer element on one or both of the sink apron and the panel to orient the panel in a vertical orientation after installation of the panel on the apron or sink.

The front of the sink or the apron may include a pocket or receptacle that is shaped and sized to receive a panel and to display the panel at the front of the installed sink. The pocket may be open at the top, side or bottom and may include a slot into or through which the panel may be inserted. The panel may include a fastener to retain the panel in the pocket, as in an example where the slot or slit is formed in the bottom or side of the apron. The pocket may include a door or cover that may be fastenable in a closed condition to close the slot and retain the panel therein.

The panel may include a tapered or non-tapered dovetail feature at a rear side or top side thereof, for example, which fits to a corresponding tapered or non-tapered dovetail slot in the sink or apron. The pin of the dovetail can be on either the panel or the sink. The dovetail joint may be horizontal such that the panel is inserted sideways into the slot of the sink or apron and may be configured to self tighten as the panel is inserted. The slot may be a non-tapered and square or rectangular and the panel may have a corresponding tab or tongue that fits into the slot. The panel may be held in position in the slot alone or in combination with other fastener devices, such as screws, bolts, key and key-hole assemblies, snap clips, and so on. Alternatively, the panel may be held in position in the apron only with fastener devices, such as screws, bolts, key and key-hole assemblies, snap clips, and so on. The panel can be held in position by a plurality of key hole or T-slots and corresponding stud structures. Furthermore, the panel can be secured in place with a cam-activated locking device.

Similarly, the panel may include a hook feature that engages a corresponding hinge joint that is formed on an underneath of the sink flange at the front thereof. The panel hangs from the hinge joint and may be inserted sideways or hung directly from the hinge joint.

In another embodiment, the panel is held on the apron by a solenoid that incorporates a locking pin. The pin is caused to be inserted into a corresponding opening in the panel by energizing, through an electric circuit, a solenoid. The circuit is provided with a suitable electric current and may include a switch. Actuation of the switch to permit the solenoid to be provided with electrical current withdraws the pin(s) and permits the panel to be disconnected from the apron and replaced by an alternative panel or the original panel. When the switch is manipulated to cause the circuit to open, the pin, which is biased in a panel engaging condition, is inserted into the openings and holds the panel in position. Alternatively, the solenoids can be configured to withdraw the pins when provided with current.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A sink, comprising:

a basin body having a generally concave shape that forms at least one sink basin;

an apron connected to the basin body;

a replaceable panel removably connected to the apron;

one or more plates fastened to the removable panel; and a fastening system disposed on the one or more plates fastened to the replaceable panel and the apron, the fastening system releasably connecting the replaceable panel to the apron, the fastening system comprising a plurality of studs disposed on the one or more plates fastened to the replaceable panel, and a stud-receiving structure disposed on the apron.

2. The sink of claim 1, including a pair of plates, each plate including a pair of the plurality of studs, each of the plates being vertically oriented.

3. The sink of claim 1, wherein the stud-receiving structure includes a plurality of spring clips disposed in the apron, each of the spring clips disposed so as to receive and releasably retain one of the plurality of studs and align the replaceable panel to the apron when so retained.

4. The sink of claim 3, wherein the plurality of studs are one of ball-shaped and barrel-shaped.

5. The sink of claim 1, wherein the stud-receiving structure includes keyholes formed in the apron.

6. The sink of claim 5, wherein the keyholes include an opening at one end thereof and a slot that tapers by narrowing away from the opening.

7. The sink of claim 6, wherein the keyholes include a first pair of keyholes, the first pair of keyholes being disposed in a vertically spaced orientation on the apron, the first pair of keyholes being engageable in opposite directions.

8. The sink of claim 7, wherein an upper one of the first pair of keyholes is engageable by a button stud in a first direction and a lower one of the first pair of keyholes is engageable in a second direction.

9. The sink of claim 8, keyholes include a second pair of keyholes, the first pair of keyholes being disposed in a vertically spaced orientation on the apron, the second pair of keyholes being engageable in opposite directions.

10. The sink of claim 9, wherein an upper one of the second pair of keyholes is engageable by a button stud in a third direction and a lower one of the second pair of keyholes is engageable in a fourth direction, wherein the first and fourth direction is the same and the second and third direction is the same.

11. The sink of claim 10, wherein in a first orientation of the replaceable panel a first one of the button studs is disposed on the replaceable panel aligned with the upper one of the first pair of keyholes and a second one of the button studs is disposed on the replaceable panel aligned with the lower one of the second pair of keyholes.

12. The sink of claim 10, wherein in a second orientation of the replaceable panel a first one of the button studs is disposed on the replaceable panel aligned with the lower one of the first pair of keyholes and a second one of the button studs is disposed on the replaceable panel aligned with the upper one of the second pair of keyholes.

13. A method of using a sink having an apron, comprising:

providing a basin body having a top flange integrally formed with the basin body, the top flange extending around the at least one sink basin;

providing an apron extending from a front edge of the top flange;

removably connecting a replaceable panel to the apron using a fastening system disposed between the replaceable panel and the apron, the fastening system including button studs attached to one of the replaceable panel and the apron and keyholes formed in the other of the replaceable panel and the apron;

wherein the replaceable panel is attached to the apron by inserting the button studs into keyholes and locking the replaceable panel in position on the apron by, in a first orientation, moving the replaceable panel in a first direction relative to the apron, and in a second orientation, moving the replaceable panel in a second direction relative to the apron.

14. The method of claim 13, wherein the first and second direction are substantially opposite horizontal directions.

15. A sink, comprising:

a basin body having a generally concave shape that forms at least one sink basin;

an apron connected to the basin body, the apron including a slot at or near an upper end thereof and an opening;

a replaceable panel removably connected to the apron; and a fastening system disposed on the replaceable panel and the apron, the fastening system releasably connecting the replaceable panel to the apron, the fastening system comprising:

a tab that extends from or is attachable to the panel, the tab positioned, sized and shaped to be received in the slot, a stud that extends from or is attachable to the panel, the stud, positioned, sized and shaped to be received through the opening, and a fastener releasably attachable to the stud to secure the panel to the apron.

16. The sink of claim 15, wherein the apron includes a pair of spaced slots.

17. The sink of claim 16, wherein the apron includes a pair of openings positioned at or near a lower end thereof.

18. The sink of claim 17, wherein the pair of openings are elongated.

19. The sink of claim 15, wherein the fastener includes a nut.

20. The sink of claim 15, wherein the tab is an extension of the panel.

21. The sink of claim 15, wherein the stud is attached to the panel.

22. The sink of claim 15, wherein the panel includes a unitary metal housing.

23. The sink of claim 15, further comprising an adapter plate attachable to the apron and configured to support the panel.

24. The sink of claim 23, wherein the adapter plate includes at least one bracket configured to support the panel.

25. The sink of claim 24, wherein adapter plate includes the tab.

26. The sink of claim 25, wherein the apron includes a pair of spaced slots and the adapter plate includes a pair of tabs configured to be received in the pair of spaced slots.

27. The sink of claim 26, wherein the adapter plate includes the stud.

28. The sink of claim 27, wherein the apron includes a pair of spaced openings and the adapter plate includes a pair of spaced studs configured to be received in the pair of spaced openings.

* * * * *